US006537650B1

(12) United States Patent
Waller, Jr. et al.

(10) Patent No.: US 6,537,650 B1
(45) Date of Patent: Mar. 25, 2003

(54) INKJET RECEPTOR MEDIUM HAVING INK MIGRATION INHIBITOR AND METHOD OF MAKING AND USING SAME

(75) Inventors: Clinton P. Waller, Jr., White Bear Lake; Omar Farooq, Woodbury; James S. Mrozinski, Oakdale; Mahfuza B. Ali, Mendota Heights, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/099,956

(22) Filed: Jun. 19, 1998

(51) Int. Cl.[7] ..... B41M 5/00

(52) U.S. Cl. ..... 428/195; 428/207; 428/331; 428/305.5; 428/306.6; 428/500; 347/106

(58) Field of Search ..... 526/258, 317.1, 526/318.3, 318.5; 427/385.5; 428/195, 304.4, 305.5, 306.6, 308.4, 308.8, 500, 507, 515, 207, 331; 347/106

(56) References Cited

U.S. PATENT DOCUMENTS

| | | | | |
|---|---|---|---|---|
| 4,247,498 | A | 1/1981 | Castro | 264/41 |
| 4,419,388 | A | 12/1983 | Sugiyama et al. | 427/288 |
| 4,474,847 | A | 10/1984 | Schroder et al. | 428/323 |
| 4,539,256 | A | 9/1985 | Shipman | 428/315.5 |
| 4,547,405 | A | * 10/1985 | Bedell et al. | 427/256 |
| 4,554,181 | A | 11/1985 | Cousin et al. | 427/261 |
| 4,613,441 | A | 9/1986 | Kohno et al. | 210/500.36 |
| 4,649,064 | A | 3/1987 | Jones | 427/256 |
| 4,726,989 | A | 2/1988 | Mrozinski | 428/315.5 |
| 4,732,786 | A | 3/1988 | Patterson et al. | 427/261 |
| 4,741,969 | A | * 5/1988 | Hayama et al. | 428/514 |
| 4,775,594 | A | 10/1988 | Desjarlais | 428/421 |
| 4,781,985 | A | 11/1988 | Desjarlais | 428/421 |
| 4,867,881 | A | 9/1989 | Kinzer | 210/490 |
| 4,877,680 | A | * 10/1989 | Sakaki et al. | 428/332 |
| 4,892,779 | A | 1/1990 | Leatherman et al. | 428/220 |
| 4,903,039 | A | 2/1990 | Light | 346/1.1 |
| 4,903,040 | A | 2/1990 | Light | 346/1.1 |
| 4,935,307 | A | 6/1990 | Lqbal et al. | 428/500 |
| 4,954,395 | A | 9/1990 | Hasegawa | 428/318.4 |
| 5,079,319 | A | * 1/1992 | Mueller | 526/238.23 |
| 5,084,340 | A | 1/1992 | Light | 428/327 |
| 5,102,731 | A | 4/1992 | Takimoto et al. | 428/323 |
| 5,120,594 | A | 6/1992 | Mrozinski | 428/195 |
| 5,126,194 | A | 6/1992 | Light | 428/327 |
| 5,126,195 | A | 6/1992 | Light | 428/327 |

(List continued on next page.)

FOREIGN PATENT DOCUMENTS

| | | |
|---|---|---|
| DE | 196 28 341 | 9/1998 |
| EP | 0 199 874 | 11/1986 |
| EP | 0 457 728 | 11/1991 |
| EP | 0 484 016 A1 | 5/1992 |
| EP | 0 570 515 B1 | 11/1993 |
| EP | 0 614 771 A1 | 9/1994 |
| EP | 0 627 324 A1 | 12/1994 |
| EP | 0 661 168 A3 | 7/1995 |
| EP | 0 667 246 A1 | 8/1995 |
| EP | 0 673 782 A2 | 9/1995 |
| EP | 0 716 931 A1 | 6/1996 |
| EP | 0 736 392 | 10/1996 |
| EP | 0 791 473 A2 | 8/1997 |
| EP | 0 839 880 | 5/1998 |
| EP | 0 876 914 A1 | 11/1998 |
| EP | 0 878 319 A2 | 11/1998 |
| EP | 0 894 641 | 2/1999 |
| EP | 0 897 808 A1 | 2/1999 |
| GB | 2 147 003 | 5/1985 |
| JP | 61-063476 | 1/1986 |
| JP | 61-41585 | 2/1986 |
| JP | 61-261089 | 11/1986 |
| WO | WO 93/01938 | 2/1993 |
| WO | WO 93/25595 | 12/1993 |
| WO | WO 95/28285 | 10/1995 |
| WO | WO 96/18496 | 6/1996 |
| WO | WO 97/20697 | 6/1997 |
| WO | WO97/33758 | 9/1997 |
| WO | WO 98/02314 | 1/1998 |
| WO | WO 98/05504 | 2/1998 |
| WO | WO 98/05512 | 2/1998 |
| WO | WO98/29516 | 7/1998 |
| WO | WO 98/30749 | 7/1998 |
| WO | WO 99/03685 | 1/1999 |
| WO | WO 99/06219 | 2/1999 |
| WO | WO 99/07588 | 2/1999 |

OTHER PUBLICATIONS

*Encyclopedia of Polymer Science and Engineering,* vol. 17, pp. 204–214, 229, 234–235, John Wiley & Sons, Inc., 1989.*

R.E. Kestings, *Synthetic Polymeric Membranes:* A Structural Perspective, 2d ed., John Wiley & Sons, 1985 Chapter 7, pp. 237–285. (No month).

International Specialty Products (brochure), Industrial Reference Guide, "Polymers—Polyvinylpyrrolidone," 2 pgs. (Date not given).

International Specialty Products (brochure), Polyvinylpyrrolidone Polymers, "PVP," 16 pgs. (Date not given).

Honby et al., "Acrylidone Anionic Copolymers," 5 pgs., International Specialty Products (brochure), Reprinted from Soap/Cosmetics/Chemical Specialties (Jun., 1993).

International Specialty Products (brochure), "Acrylidone™ Anionic Polymers," 6 pgs. (Date not given).

Porterfield, William J., *Inorganic Chemistry,* Addison–Wesley Publishing Company, Inc., p. 133 (1984). (No month).

*Primary Examiner*—Marie Yaminitzky
(74) *Attorney, Agent, or Firm*—Carolyn V. Peters; John H. Hornickel

(57) ABSTRACT

A homopolymer or copolymer useful for inhibiting the migration of pigmented inks in porous inkjet receptor media is disclosed. The copolymer is comprised of at least two different hydrophilic monomers, each of whose homopolymers are hydrophilic yet the resulting copolymer from the different hydrophilic monomers is sparingly soluble in water. Methods of making and using such copolymer are also disclosed.

12 Claims, 2 Drawing Sheets

U.S. PATENT DOCUMENTS 5,141,790 A 8/1992 Calhoun et al. ..... 428/40
5,147,410 A 9/1992 Heindl et al. ..... 8/555
5,156,674 A 10/1992 Cells ..... 106/20
5,206,071 A 4/1993 Atherton et al. ..... 428/195
5,208,092 A 5/1993 Iqbal ..... 428/195
5,220,346 A 6/1993 Carreira et al ..... 346/1.1
5,229,207 A 7/1993 Paquette et al. ..... 428/355
5,262,238 A * 11/1993 Trouve et al. ..... 428/402
5,296,277 A 3/1994 Wilson et al. ..... 428/40
5,302,437 A 4/1994 Idei et al. ..... 428/195
5,342,688 A 8/1994 Kitchin et al. ..... 428/402
5,362,516 A 11/1994 Wilson et al. ..... 427/207.1
5,374,475 A 12/1994 Walchli ..... 428/304.4
5,380,044 A 1/1995 Aitkens et al. ..... 283/67
5,389,723 A 2/1995 Iqbal et al. ..... 525/57
5,428,383 A 6/1995 Shields et al. ..... 347/96
5,429,860 A 7/1995 Held et al. ..... 428/195
5,443,727 A 8/1995 Gagnon ..... 210/490
5,445,868 A 8/1995 Harasawa et al. ..... 428/206
5,500,668 A 3/1996 Molhotra et al. ..... 347/105
5,518,534 A 5/1996 Pearlstine et al. ..... 106/20 R
5,537,137 A 7/1996 Held et al. ..... 347/105
5,569,529 A 10/1996 Becker et al. ..... 428/331
5,624,484 A 4/1997 Takahashi et al. ..... 105/31.75
5,640,187 A 6/1997 Kashiwazaki et al. ..... 347/101
5,677,067 A 10/1997 Kojima et al. ..... 428/478.2
5,679,143 A 10/1997 Looman ..... 106/20 R
5,681,660 A 10/1997 Bull et al. ..... 428/500
5,683,793 A 11/1997 Malhotra et al. ..... 428/216
5,686,602 A 11/1997 Farooq et al. ..... 536/101
5,688,603 A 11/1997 Iqbal et al. ..... 428/532
5,695,820 A 12/1997 Davis et al. ..... 427/261
5,707,722 A 1/1998 Iqbal et al. ..... 428/304.4
5,731,430 A 3/1998 Fuertes et al. ..... 536/58
5,747,148 A 5/1998 Warner et al. ..... 428/212
5,789,342 A 8/1998 Evans et al. ..... 503/227
5,800,919 A 9/1998 Peacock et al. ..... 428/355
5,863,662 A * 1/1999 Hornby et al. ..... 428/483
5,874,143 A 2/1999 Peloquin et al. ..... 428/40.1
5,885,337 A 3/1999 Nohr et al. ..... 106/31.27
6,054,213 A 4/2000 Peacock et al. ..... 428/355
6,071,614 A 6/2000 Farooq ..... 428/403
6,177,187 B1 1/2001 Niemoller et al. ..... 428/327

* cited by examiner

INKJET RECEPTOR MEDIUM HAVING INK MIGRATION INHIBITOR AND METHOD OF MAKING AND USING SAME

COLOR PHOTOGRAPHS

The file of this patent contains at least one drawing executed in color. Copies of this patent with color drawings will be provided by the Patent and Trademark Office upon request and payment of the necessary fee.

FIELD OF INVENTION

This invention relates to a microporous inkjet receptor that provides excellent images with pigmented inks deposited thereon in a manner that impedes migration of the pigmented inks when in contact with water.

BACKGROUND OF INVENTION

Inkjet imaging techniques have become vastly popular in commercial and consumer applications. The ability to use a personal computer and desktop printer to print a color image on paper or other receptor media has extended from dye-based inks to pigment-based inks. The latter provide brilliant colors and more durable images because pigment particles are contained in a dispersion before being dispensed using a thermal inkjet print head, such as those commercially available from Hewlett Packard Corporation or LexMark Corporation in inkjet printers commercially available from Hewlett Packard Corporation, Encad Inc., Mimaki Corporation, and others.

Ink jet printers have been in general use for wide-format electronic printing for applications such as, engineering and architectural drawings. Because of the simplicity of operation, economy of ink jet printers, and improvements in ink technology the inkjet imaging process holds a superior growth potential promise for the printing industry to produce wide format, image on demand, presentation quality durable graphics.

The components of an ink jet system used for making graphics can be grouped into three major categories:

1 Computer, software, printer.

2 Ink.

3 Receptor sheet.

The computer, software, and printer will control the size, number and placement of the ink droplets and will transport the receptor film. The ink will contain the colorant or pigments which form the image and the receptor film provides the medium which accepts and holds the ink. The quality of the ink jet image is a function of the total system. However, the composition and interaction between the ink and receptor film is most important in an ink jet system.

Image quality is what the viewing public and paying customers will want and demand to see. Many other demands are also placed on the ink jet media/ink system from the print shop, such as rapid drying, humidity insensitivity, extended shelf life, waterfastness and overall handleability. Also, exposure to the environment can place additional demands on the media and ink (depending on the application of the graphic).

Porous membrane is a natural choice to use as an ink jet receptive media because the capillary action of the porous membrane can wick the ink into the pores much faster than the absorption mechanism of film forming water soluble coatings. However, in the past, when a porous coating or film has been employed to achieve desired quick dry, optical density has suffered greatly because the colorant penetrates too deep into the porous network. This type of problem is magnified by printers that dispense high volumes of ink per drop because extra film thickness may be required to hold all the ink. When the pore size and pore volume of the membrane are opened to allow the pigments to penetrate, the pigments can be stratified in the membrane. Meaning, the black, cyan, magenta, and yellow will be predominately found at different depths depending on the order of application. Hence, some of the first color(s) applied is /are optically trapped in the image by subsequent application of other pigmented ink. Furthermore, lateral diffusion of the ink can also be a problem inherent in porous membranes used as receptive media. When pigmented inks are jetted onto a porous film that has a pore size that is too small, color pigments will be filtered on the top of the membrane rendering high image density, but the pigments could easily smear and have the effect of never drying. Also, excess fluid from the ink can coalesce, or even worse, pool and run on the image before the water/glycol carrier is wicked away.

The chemical formulation of the pigmented inkjet ink has considerable complexity due to the requirement of continued dispersion of the pigment particles in the remainder of the ink and during jetting of the ink.

The typical consumer medium for receiving dye-based inkjet inks has been paper or specially coated papers. However, with too much inkjet ink in a given area of the paper, one can see the over-saturation of the paper with the aqueous ink in which dye was dissolved.

As inkjet inks have become more commercially oriented and pigmented-based inks have become more prevalent, different media have been tried in an attempt to control the management of fluids in the ink.

Japanese Patent JP 61-041585 discloses a method for producing printing material using a ratio of PVA/PVP. The disadvantage is inadequate waterfastness and wet rub off properties.

Japanese Patent JP61-261089 discloses a transparent material with cationic conductive resin in addition to a mixture of PVA/PVP. The material is water fast and smudge proof but the wet rub off properties are poor.

European Patent Publication EP 0 716 931 Al discloses a system using a dye capable of co-ordinate bonding with a metal ion in two or more positions. Again binder resins are used with inorganic pigments in the paper or film. The metal ion was preferred to be jetted on before imaging and additional heating is necessary to complete the reaction. This system was not claiming to be water fast; the focus was long term storage without fading from heat or light.

U.S. Pat. No. 5,537,137 discloses a system to achieve waterfastness by curing with heat or UV light. In the body of the patent, examples of their coatings contained Ca++ from $CaCl_2$. This was added to provide reactive species for the acid groups on the dispersed polymer. The coating remains water soluble until UV or heat curing after imaging.

Hence, the current special ink jet media employ vehicle absorptive components, and sometimes optional additives to bind the inks to the media. As a consequence current media are inherently moisture sensitive and can be fragile to handling and subject to finger smearing. Moreover, the vehicle absorptive components usually consist of water soluble (or swelling) polymers which result in slower printing speeds and dry times.

Pigmented ink delivery systems have also dealt with pigment management systems, wherein the resting location of the pigment particles are managed to provide the best possible image graphic. For example, U.S. Pat. No. 5,747, 148 (Warner et al.), discloses a pigment management system in which a suitable supporting layer (including in a listing a microporous layer) has a two layer fluid management system: a protective penetrant layer and a receptor layer, both layers containing filler particles to provide two different types of protrusions from the uppermost protective penetrant layer. Electron microphotographs in that application show how the pigment particles of the ink encounter smooth protrusions that provide a suitable topography for pigment particle "nesting" and rocky protrusions that assist in media handling and the like.

Other ink receptors have been disclosed, including U.S. Pat. Nos. 5,342,688 (Kitchin); 5,389,723 and 4,935,307 (both Iqbal et al.); 5,208,092 (Iqbal) 5,302,437 (Idei et al); U.S. Pat. No. 5,206,071 (Atherton et al.); and EPO Patent Publication 0 484 016 A1.

One prior activity has combined a fluid management system with a pigment management system, as disclosed herein and in copending, coassigned, U.S. patent application Ser. No. 08/892,902, the disclosure of which is incorporated herein by reference. This work solves the need for an inkjet receptor to have both a pigment management system for flocculating or agglomerating incoming pigment/dispersant particles and a fluid management system for efficiently dispensing with the carrier fluids within a porous substrate.

SUMMARY OF INVENTION

It has been found that inkjet receptor media require durability for exposure to water in the form of humidity, rain, dew, snow, and the like.

It has also been found that pigment particles in aqueous inkjet ink formulations require time to establish a stable relationship with the medium upon which they have been deposited during inkjet printing.

It has been found that pigment particles are capable of migration within pores of a porous inkjet receptor medium, even if such receptor medium has both a fluid management system and a pigment management system.

What the art needs is an inkjet receptor medium that assures rapid establishment of a stable relationship between pigment particles (and their dispersants) and the inkjet receptor medium, particularly when the printed medium is likely to be exposed to water or other solvents shortly after printing.

One aspect of the present invention is a migration inhibitor for pigmented inks comprising a copolymer of at least two different hydrophilic monomers, each of whose homopolymers are hydrophilic yet the resulting copolymer from the different hydrophilic monomers is sparingly soluble in water.

For purposes of this application, "soluble in water" means dissolution of the monomer or polymer in deionized water at room temperature (about 15–18° C.) at a rate of 50–90 grams/100 g of water. By contrast, "sparingly soluble in water" means the monomer or polymer is capable of being dispersed in deionized water at room temperature (about 15–18° C.) without becoming substantially dissolved (no more than about 1 gram/100 grams of water) in that deionized water, notwithstanding possible solubility in blends of water and other hydrophilic solvents.

One feature of the present invention is a homopolymer or copolymer that has hydrophilic interaction sites for both pigmented particles and their associated dispersants and hydrophilic interaction sites for multivalent metal ion coordination. "Hydrophilic interaction" in the present context means a physicochemical phenomenon whereby the functional group(s) in the homopolymer or copolymer undergoes interactions with the dispersants and the metal ions in hydrophilic medium.

One advantage of the present invention is that a dispersible-co-soluble hydrophilic copolymer or hydrophilic homopolymer of the present invention can substantially immobilize pigment particles and their associated dispersants from migration when the printed inkjet receptor medium comes in contact with water.

Other features and advantages of the invention will be disclosed in relation to the embodiments of the invention, using the following drawings.

EMBODIMENTS OF INVENTION

Pigment Management System

Figure 1:
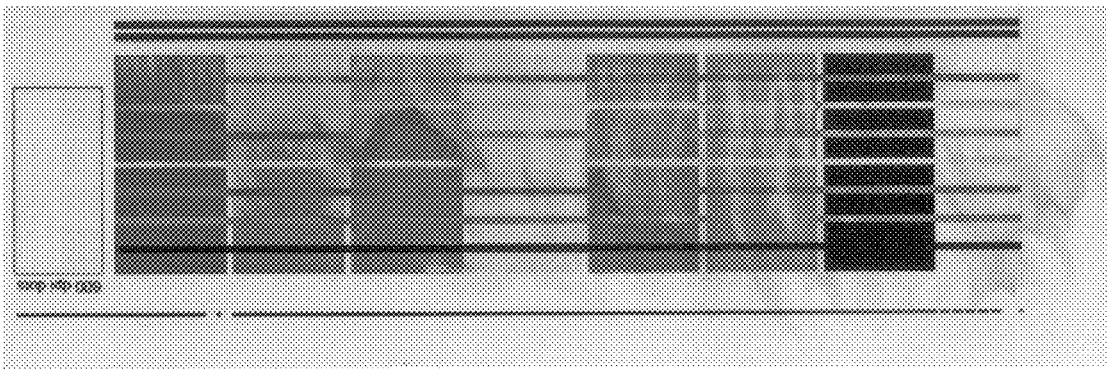
FIG. 1 Prior Art
FIG. 1 is a comparison color photograph showing pigment migration when inkjet receptor medium has not employed the pigment migration inhibitor of the present invention.

The microporous material has a pigment management system based on addition of materials into the pore volume of the porous substrate.

Two embodiments are disclosed for the Pigment Management System: Silica Agglomerates and Multivalent Metal Salts. There are benefits of both and some distinctions that can be employed by those skilled in the art to advantage.

Both embodiments provide a quick dry, high color density, high resolution image that is smudge resistant (if the silica agglomerates reside below the exposed surface of the receptor medium).

The silica agglomerate embodiment works with both dye-based and pigment-based inks, whereas the metal salt embodiment works better with pigment-based inks.

The silica agglomerate is not soluble in water either for preparing imbibing solutions or after imaging. The metal salt is soluble in water for both preparing solutions and during imaging, but not after complexing with the dispersing aid that surrounds the pigment particles in the ink.

The silica agglomerate is composed of particles trapped inside the porous receptor medium, whereas the metal salt is composed of coatings on the interior surfaces of the porous receptor medium.

The silica agglomerate is believed to serve as a chemical trap, a functionalized silica, of ink passing through the interior pores interacting with dispersants that surround pigment particles, leaving the colorant with the agglomerate, providing a chemical means of pigment management based on particulates within the pores. The metal salt is believed to serve as reagents to rapidly destabilize dispersants surrounding the pigment particles in the ink, whereby the pigment particles coagulate or flocculate as the remainder of the ink fluid continues through pores and along the surfaces of the receptor medium. The multivalent salts therefore provide a chemical means of pigment management along surfaces of the pores.

The former requires penetration into the porous receptor medium to minimize physical removal from the medium. The latter coats surfaces of the receptor medium and, once dried, is resistant to physical removal.

One way to qualify various pigment management systems is to place a quantity of the targeted ink into a solution of a pigment management system. A non-particulate chemical acting as in pigment management will flocculate and separate the pigment particles from the ink, rapidly separating the appearance of the experimental liquid into two layers, whereas a particulate chemical acting pigment management will not separate rapidly the experimental liquid into two layers.

While two embodiments are described in more detail below, one skilled in the art can also employ other compositions to provide either primarily physical or primarily chemical means of pigment management without departing from the scope of the present invention.

Silica Agglomerates

One embodiment of the pigment management system used in the present invention relies on fluorinated silica agglomerates filling at least a significant portion of the pore volume of the microporous material. The silica-agglomerates are hydrophobic and are sympathetic with pigment particles dispersed within a pigmented ink.

Details of the preparation of fluorinated silica particles are disclosed in U.S. Pat. No. 6,071,614, issued Jun. 6, 2000, to Farooq, the disclosure of which is incorporated herein by reference. Briefly, the preparation can be represented by the following equation:

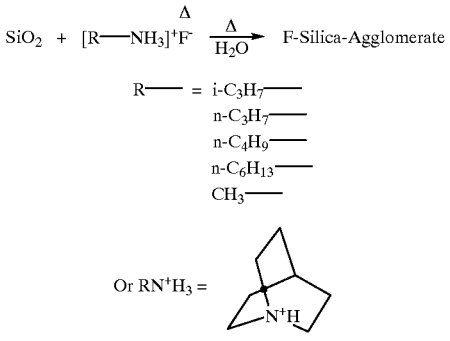

The size of the silica particles can range from about 0.1 to about 50 $\mu$m and preferably from about 1 to about 10 $\mu$m.

The amount of the silica particles can range from about 2 to about 20 weight percent and preferably from about 3 to about 10 weight percent. Impregnation of the silica particles into the pore volume of the microporous membrane requires the particles not to be oversized and operates according the discussion above.

One advantage of functionalized silica particles discussed above is their microporosity which can aid in the physical interaction of pigment particles in ink moving through the pores of the substrate. A more important advantage is their functionalized surfaces for interaction with dispersants engaged with those pigment particles.

Multivalent Metal Salts

A second embodiment of the pigment management system relies on a multivalent metal salt or salts to control the reception of pigment particles onto the porous surfaces of the receptor.

Nonlimiting examples of multivalent metal salts useful in the present invention include the metal cations from Group 11 and above in the Periodic Table, such as Ca, Mg, Ti, Zr, Fe, Cu, Zn, Ta, Al, Ga, Sn. Examples include a single salt, a binary salt, or a ternary salt containing counterions such as nitrate, sulfate, nitrite, acetate, sulfite, bisulfite, alkanesulfonate, fluoroalkanesulfonates, perchlorate, halide, pseudo-halides, propionate, and the like, and combinations thereof.

Other examples of multivalent metal salts depend on and operate within the conditions of solubility rule concerning the dissolving of salts in water, (General Chemistry Principles and Structure $5^{th}$ edition p. 132). These rules have hierarchy, meaning if there is conflict with a rule, the preceding rule takes precedence. For example, rule 8 states all carbonates ($CO_3^{-2}$) are insoluble in water. The exceptions to this rule are found when following rules 1 and 2, which is all salts of the alkali metals and all salts of the ammonium ($NH_4^+$) ion are soluble. To employ these rules means that the ammonium and the alkali metal salts do not flocculate ink on contact when imbibed in the porous membrane. Therefore, the salts formed by the carbonate ion are not as useful as other counter ions. As another example, the salt, NaCl, does not flocculate the ink as it contains only the +1 cation (sodium) found in Group 1A of the Periodic Table. The salt, $CaCl_2$ does flocculate the ink as the +2 (calcium) is found in Group IIA.

Specific examples of preferred salts include aluminum sulfate, aluminum nitrate, gallium nitrate, ferrous sulfate, chromium sulfate, calcium propionate, zinc sulfate, zinc acetate, zinc chloride, calcium chloride, calcium bromide, magnesium sulfate, magnesium chloride, and combinations thereof. These compounds are typically sold and can be used in the hydrated form. Of the various possible salts, aluminum sulfate is presently preferred.

The amount of salts that can be used in the coating solution for imbibing in the porous substrate of the present invention can range from about 0.5 wt % to about 50.0 wt %, and preferably from about 1.0 wt % to about 10.0 wt %.

Inkjet Receptor Medium

The inkjet receptor medium can be any porous membrane or film known to those skilled in the art wherein it is desired to print inkjet inks on at least one major surface thereon. Preferably, the medium comprises an inkjet receptor medium, comprising a porous substrate having a fluid management system and having a pigment management system in contact with surfaces of pores of the substrate therein, such as disclosed herein and in copending, coassigned, U.S. patent application Ser. No. 08/892,902, the disclosure of which is incorporated herein. One embodiment of that medium is an inkjet receptor comprising a microporous membrane impregnated with an inorganic multivalent metal salt together with a surfactant or combination of surfactants chosen for the ink and membrane being employed.

Another embodiment is an inkjet receptor comprising a microporous membrane impregnated with a microporous fluorinated silica agglomerate together with a binder and a surfactant or a combination of surfactants for the ink and membrane being employed.

Another embodiment of the present invention is an inkjet receptor comprising a microporous membrane impregnated with a microporous fluorinated silica agglomerate together with a binder and a surfactant or combination of surfactants wherein the said surfactants are selected from the group of hydrocarbon-based anionic surfactants, silicon-based non-ionic surfactants or fluorocarbon-based non-ionic based surfactants or a combination thereof.

These receptors, when imaged in an inkjet printer, provide very high density and very high quality images which are tack-free and instantaneously dry to touch.

The ink colorant is typically a pigment dispersion having a dispersant that binds to the pigment and that will destabilize, flocculate, agglomerate, or coagulate the pigments on contact with the media component. Depositing each of the colors at or just below the surface of the membrane allowing the carrier fluid to wick into the membrane where the fluid management system can take over while providing a sheltered location for the pigments as managed by the pigment management system.

More preferably, the inkjet receptor medium uses a Thermally Induced Phase Separated (T.I.P.S.) microporous membrane disclosed in U.S. Pat. No. 4,539,256 (Shipman) and available from 3M. For optimization, the pore size and pore volume of the porous film can be adjusted for the model or make of the ink jet printer to correctly hold the volume of ink dispensed by the printer ensuring the highest possible image quality. The coating on the preferred media/ink set has special utility in the demanding ink jet printing applications found in commercial printing. Thus, one can "fine tune" the properties of these receptors to deal with the variables of inkjet ink delivery, including without limitation: porosity of media, pore size, surface wetting energy, and other capacity issues for media to receive ink of various formulations and drop volumes. Moreover, these media exhibit a complex porosity in its porous material that provides both a tortuous path for fluid management and a tortuous path that ensnares the pigment initially and continually during ink delivery.

Pigment Migration Inhibitor

Pigment migration inhibitors useful in the present invention can be homopolymers or copolymers having any number of hydrophilic monomers, each of whose homopolymers are hydrophilic, so long as the resulting copolymer is sparingly soluble in water, as defined above. Preferably, the copolymer includes at least one water dispersible monomer and at least one water soluble monomer.

Nonlimiting examples of hydrophilic monomers are methacrylic, ethacrylic acids, acrylic acid N-Vinylphthalimide, Vinylimidazole, Vinylpyridine and N-vinyl-2-pyrrolidinone, with the last and acrylic acid being presently preferred. The homopolymer used in the present invention is a polyvinylpyrrolidinone (PVP) of relatively high molecular weight available from commercial sources.

Molecular weight (Number Average) has been been found to be significant for performance of the inhibitor homopolymer or copolymers of the present invention. The molecular weight of the homopolymer can range from about 10,000 to about 2,000,000 preferably, about 40,000 to about 2,000,000, and more preferably from about 500,000 to about 1,500,000. The molecular weight of the copolymer can range from about 10,000 to about 300,000 and preferably from about 20,000 to about 200,000 and more preferably from about 30,000 to about 100,000 (greater than about 35,000.). Very high molecular weight copolymer tends not to be soluble in the coating composition. The intermediate molecular weight copolymer e.g., from 30,000–100,000 as used in the present invention is fairly soluble under hot-water treatment and is therefore, workable.

Once monomers are selected, the polymerization is rather less complicated. Mixing the monomers in appropriate solvent with the right amount of initiator and subjecting the mixture to mild heating allows polymerization reaction to take place in reasonable time frame. The initiator concentration has to be adjusted in such a way so that in a given set of monomer concentrations, the copolymer with the desired molecular weight is obtained with 95–99% conversion.

Use of appropriate solvent for the copolymerization is another important aspect in the preparation of the copolymer. In such etheral solvent as THF, the reaction is very exothermic as it is in related hydrocarbon solvents. In such solvents, the polymer is formed as precipitates which is subsequently obtained by filtration via a preferable treatment in a non-solvent. Due to high exothermicity, use of such solvent is less desirable.

It is, however, more desirable to make use of such a solvent as an alcohol e.g., an ethanol which is an integral part of the coating composition. The copolymer has been prepared in methanol, ethanol and isopropanol. In methanol, the resulting copolymer is relatively more soluble and in isopropyl alcohol, it is less soluble. In ethanol, the copolymer was obtained as partly soluble and partly insoluble material; at the end of reaction the material was dissolved by adding the required amount of water to obtain a clear solution. The amount of water added is such that a definite workable concentration of the copolymer can be obtained in the mixed solvent.

The comonomer ratios determining composition of the copolymer is important. These ratios reflect not only the solubility of the copolymer in water-based composition but also determines the copolymers' inhibitor properties towards the pigment mobility. A copolymer of acrylic acid and (N-vinyl-2-pyrrolidinone) provides a balance of properties for both high density and low pigment mobility and does not adversely interfere with other properties such as fluid management and other pigment management such as flocculation/agglomeration of the pigment particles. The copolymer consisting of N-vinyl-2-pyrrolidinone ["NVP"] and acrylic acid ["AA"] preferably includes NVP in an amount of about 65–90 weight percent, and more preferably for certain embodiments about 75–90 weight percent and for other embodiments about 70–80 weight percent, and preferably includes AA in an amount of about 10–35 weight percent, and more preferably for certain embodiments about 10–25 weight percent and for other embodiments about 20–30 weight percent. The inhibition vs. image density as part of the copolymer properties is shown in the following profile:

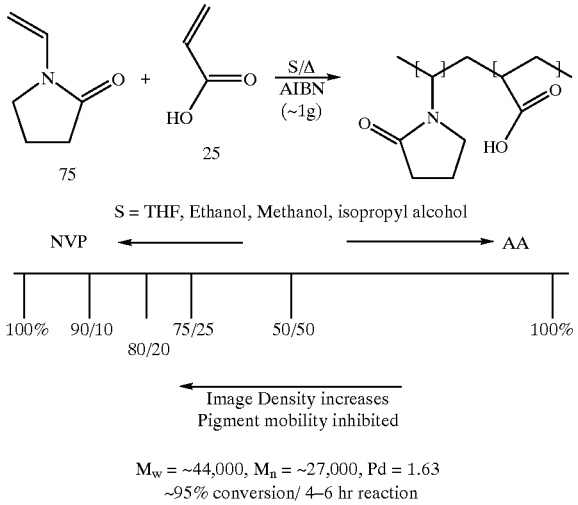

Copolymerization can be performed according to an anionic polymerization procedure as disclosed in Homby et al., *Soap/Cosmetics/Chemical Specialties,* June 1993.

Once monomers are selected, the polymerization of them has been found to be significant for performance of the inhibitors of the present invention. The weight ratio of (monomer dispersible in water such as NVP): (monomer soluble in water such as AA) can range from about 65:35 to about 90:10, and preferably about 75:25.

Polymerization of hydrophilic monomers to form a copolymer can employ any conventional polymerization technique, among included, bulk polymerization, emulsion polymerization, solution polymerization, with the last being presently preferred. Such polymerization processes can be effected by conventional procedures, among included, anionic, free-radical polymerizations, with the last being presently preferred.

After polymerization of the inhibitor copolymer, the inhibitor copolymer is added to a coating solution, such as disclosed in copending, coassigned, U.S. patent application Ser. No. 08/892,902, for coating on the inkjet receptor medium. The weight percent of the inhibitor homopolymer or copolymer in the coating solution can range from about 0.1 to about 5% in order to minimize deleterious effects on other printing properties, and preferably from about 0.3 to about 3 weight percent, and more preferably from about 0.5 to about 2% weight percent.

Use of some hydrophilic copolymers consisting of monomers being more hydrophilic and water soluble, provides enhanced image density but does not allow significant pigment inhibition in the present composition or they may interfere with other fluid management and pigment management properties such as dry time, smudge resistance, and the like. Some of such hydrophilic copolymers are shown below:

Sulfonated Styrene-Co-Maleic Anhydride ("SSMA")

This copolymer was prepared from styrene/maleic anhydride (3:1) and then the aromatic was sulfonated. Alkaline hydrolysis of the material gave hydrophilic sulfonated styrene-maleic acid copolymer in sodium-salt form.

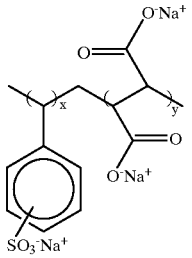

4-Component Copolymer

This copolymer consisting of NVP/HEMA/MEA/AA ($NH_4^+$) in the ratio 60:20:10:10 enhanced the ink densities but does not significantly inhibit

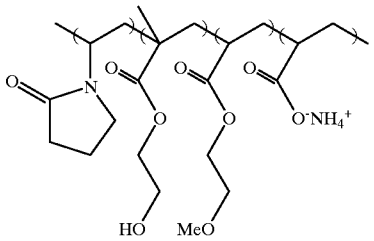

pigment migration

3-Component Copolymer

This copolymer consisting of NVP/DMAEMA/AA ($NH_4^+$) in the ratio 70:20:10 enhances the ink densities but does not significantly inhibit pigment migration.

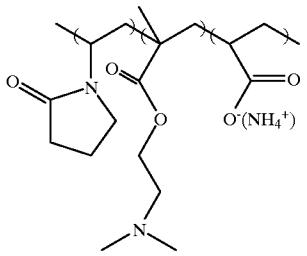

Copolymer 958

This material consisting of NVP/DMAEMA in the ratio 20:80 enhances the ink density but does not significantly inhibit pigment migration.

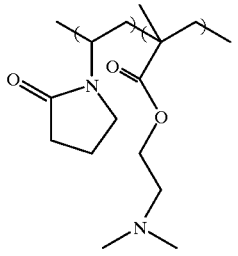

Copolymer 845

This material consisting of NVP/DMAEMA in the ratio 80:20 significantly enhances the ink density.

Yet some copolymers with both hydrophilic and hydrophobic monomers renders inhibition to the pigment mobility to a lesser extent compared to the homopolymer or the copolymer used in the present invention. Some of these copolymers are shown below:

Acrylic Resin

This material, a Carboset brand acrylic polymer containing styrene units (from B.F. Goodrich) helped reduce the black pigment mobility onto the substrate to a significant extent.

Vancryl-454

This is an ethylacrylate, methylacrylate and methacrylic acid copolymer (from Air Products)helped reduce the black pigment migration onto the substrate to a significant extent.

Latex

Some of the latices consisting of both hydrophilic and hydrophobic monomers were also used to inhibit pigment mobility. Examples of such latices are copolymer of ethylene and vinylacetate (Airflex) from Air products, copolymers of styrene and NVP from ISP. These copolymers did not effect pigment inhibition owing to their latex characetistics—they tend to plug the pores in the porous film.

Cross-linkers

Effecting pigment inhibition on the porous film was attempted by making use of certain cross-linkers e.g., aziridine couplers in the coating composition. CX-100 (from Zeneca) a liquid water-soluble cross-linker and XAMA-7 (from Ciba-Geigy) a semi-liquid water-ethanol soluble cross-linker were used in 0.5–1% range in the coating composition. Use of these cross-linkers moderately improved the black pigment fixation on the receptor on water-challenge.

Other ink receptive copolymers that are sparingly soluble in water include a copolymer of N-vinylpyrrolidone, acrylic acid, and trimethoxysilylethylmethacrylate (80/10/10); a copolymer of N-vinylpyrrolidone, acrylic acid, trimethoxysilylethylmethacrylate, and ethyleneoxide acrylate (75/10/5/10); a copolymer of N-vinylpyrrolidone, acrylic acid, and N, N, N-methyloctylheptadecafluorosulfonylethylacrylate (MeFOSEA) (80/10/10); a copolymer of N-vinylpyrrolidone, acrylic acid, trimethoxysilylethylmethacrylate and N, N, N-ethyloctylheptadecafluorosulfonylethylacrylate (MeFOSEA) (83/10/2/5); and ); a copolymer of N-vinylpyrrolidone, acrylic acid, and Sulfonated Styrene-Sodium Salt (60/10/30).

Optional Additives

In addition to the migration inhibitor of the present invention, one can add other compounds to improve image quality and stability. For example, to overcome the presence of any residue residing on the exposed surface of a porous inkjet medium, where the pigment particles are supposed to be nested within the porous surfaces of the medium, one can add a drying agent to the coating solution used to load a fluid management system and/or a pigment management system to a porous medium.

Usefulness of the Invention and Examples

It has been found that ink migration of the pigment particles can occur when a portion of a printed inkjet medium protected by an overlaminate is partially submerged in water and capillary forces cause continuous water flow within the overlaminated printed medium within the submerged portion to other locations within the submerged portion and sometimes to the unsubmerged portion. This continuous water flow in true capillary action transports pigment particles within various locations in the submerged portion and sometimes to the unsubmerged portion, leaving transported pigment particles in unintended locations which distorts the intended image. This phenomenon can be noticeable within minutes or can occur only after several hours of submersion of a portion of the printed ink. This noticeable ink migration is in a manner like thin layer chromatography. The compositions of the present invention inhibit this ink migration, delaying the phenomenon from minutes to weeks or more. Any edge of a laminated printed inkjet image or a disruption in the overlaminate can be a source for water flow or capillary action. Pigment migration could occur unless the compositions of the present invention are employed to inhibit pigment migration. The amount of water flow via capillary action can also determine the amount of migration, but printed inkjet images should be designed for possible severe conditions than to risk loss of image quality or image assurance.

FIG. 1 shows a color photograph of several colors of HP2500 Series brand pigmented inkjet inks (commercially available from Hewlett Packard Corporation of Palo Alto, Calif., USA) printed in an image of a test pattern on an inkjet receptor medium, namely, an oil-in microporous polypropylene membrane prepared according the disclosures of U.S. Pat. No. 4,539,256 (Shipman et al.), U.S. Pat. No. 4,726,989 (Mrozinski), and more particularly U.S. Pat. No. 5,120,594 (Mrozinski), the disclosures of which are incorporated herein by reference, treated with

| | |
|---|---|
| Aluminum sulfate, tetradecahydrate | 4.1% |
| Dioctylsulfosuccinate ($Dos^3$) | 7.0% |
| 5-Sulfoisophthalic Acid-Na(mono) salt | 13.8% |
| Ethanol/IPA | 25% |
| De-ionized water | 50.1% |

This membrane had the following properties:

| | |
|---|---|
| Bubble point | 0.9 $\mu$m |
| Gurley 50 $cm^3$ | 15 sec |
| Porosity % void | 38% |
| Surface wetting Energy (before treatment) | 30 dynes/$cm^2$ |
| Caliper | 0.178 mm (7 mil) |

The composition was coated onto the microporous inkjet receptor medium with a No. 4 Meyer bar. The printed medium was laminated with 3M Scotch No. 845 Book Tape and the laminated medium was adhered to a piece of anodized aluminum and approximately 75% percent was submerged in water for a period of about 4 hours. During this time of submersion, the image deteriorated due to pigment migration. Moreover, via capillary action, the pigment also wicked above the water line as seen in FIG. 1.

Figure 2:
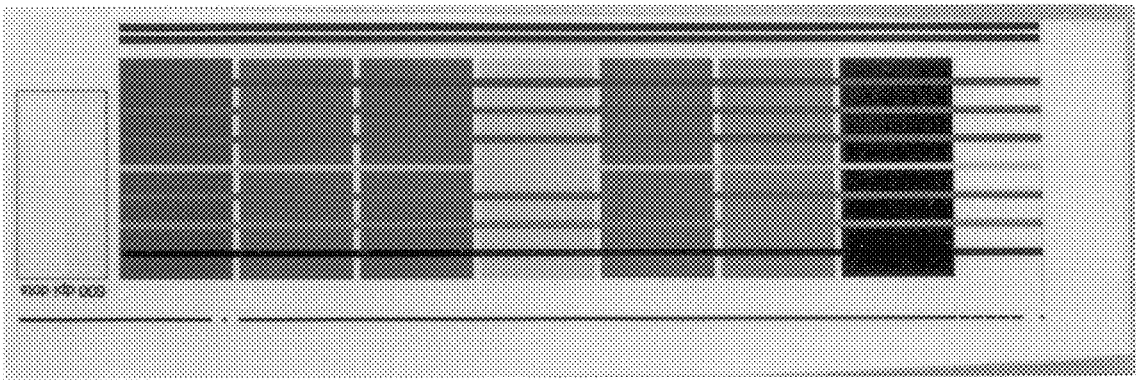
FIG. 2 is a color photograph showing substantially no pigment migration under the same conditions as seen in FIG. 1, except that the inkjet receptor medium has employed the pigment migration inhibitor of the present invention.

FIG. 2 shows a repeat of the same experiment as seen in FIG. 1, except that the formula was modified to add to coating solution 2 weight percent of N-vinyl-2-pyrrolidone-co-acrylic acid copolymer in a weight ratio of 75:25 and having a molecular weight (MWn) of about 96,000. The submersion resulted in substantially no underwater pigment migration nor wicking of any color to the waterline or above the waterline for 4 days under eye examination. Similar experiments have been run for as long as 10 days also demonstrate the properties of this invention, although failure of the test for migration will be seen usually within the first 2 days. It is presently believed that the inhibition of this invention continues indefinitely and longer than any anticipated length of image display in water-containing environments.

Work was also done replacing NVP/AA copolymer coating used in the example seen in FIG. 2 with 1,300,000 M.W. (Number Average) polyvinyl pyrrolidinone [PVP] in 0.6 wt % to obtain the similar excellent results.

Appropriate drying/heating the coated receptor prior to imaging is another important parameter in the design and development of the present high ink-volume microporous inkjet receptor. It was found that lack of appropriate drying can cause the ink (pigment) to migrate in the under-water test even though all other conditions are satisfied. It was, further, found that hand-held heat guns could cause insufficient or uneven drying of the receptor. A uniform oven-drying the receptor after coating from 90° C. to about 120° C. for about 1–3 mins and more preferably for about 1–1.5 mins provides sufficient drying to induce chemical-fixation of the ingredients, components or compounds of the composition into the porous film. Then the coated, dried membrane can be stored for a considerable period of time (at least one year) before printing. The procedure allows no pigment migration in any of the water tests described for an indefinite period of time.

Another test for pigment movement or migration from water is the following water spray test:

Water Spray Test

Tempered water from a standard 1.90 cm (¾ inch) aerated faucet was allowed to drop 0.61 meters (2 feet) at a rate of 6 liters per minute for 5 minutes onto the coated film sample which was imaged with a test pattern (the same pattern as seen in FIGS. 1 and 2). The sample was moved about so each color area could receive the water stream directly. The sample was removed from the water stream, allowed to dry and observed for ink movement. For ease and documentation of this test, each sample was adhered to an aluminum plate and the test was performed about 10 minutes after printing.

Imaged membranes benefiting from the present invention pass this Water Spray Test.

While not being limited to a particular theory, it is believed that the dispersants, surrounding a pigment particle that have not yet become agglomerated according to the pigment management system disclosed herein and in application Ser. No. 08/892,902, have nonetheless become associated with the migration inhibitor copolymer through hydrophilic interaction. Moreover, the molecular weight of the migration inhibitor copolymer results in establishment of pigment stability in the medium because of the tortuous path within the porous medium is far less likely to permit capillary action for a pigment particle associated with a homopolymer or copolymer having such molecular weight or the copolymer having reduced hydrophilicity.

The work seen in FIGS. 1 and 2 was repeated successfully using a microporous membrane prepared using thermally induced phase separation techniques according the disclosures of U.S. Pat. No. 4,539,256 (Shipman et al.), U.S. Pat. No. 4,726,989 (Mrozinski), and more particularly U.S. Pat. No. 5,120,594 (Mrozinski), the disclosures of which are incorporated herein by reference. This membrane had the following properties:

| | |
|---|---|
| Bubble point | 0.75 $\mu$m |
| Gurley 50 $cm^3$ | 20 sec |
| Porosity % void | 41% |
| Surface wetting Energy (before treatment) | 30 dynes/$cm^2$ |
| Caliper | 0.178 mm (7 mil) |

The membrane was treated with a coating of

| | |
|---|---|
| Aluminum sulfate, tetradecahydrate | 3.3% |
| Dihexylsulfosuccinate | 6.0% |
| 5-Sulfoisophthalic Acid-Na(mono) salt | 7.0% |
| Phthalic acid | 4.0% |
| Ethanol/IPA | 26% |
| De-ionized water | 53.7%. |

The example was repeated with another piece of the same membrane, which was also impregnated with another coating solution consisting of:

| | |
|---|---|
| Aluminum sulfate, tetradecahydrate | 5.0% |
| Dicyclohexylsulfosuccinate | 6.0% |
| D,L-2-Pyrrolidone 5-carboxylic acid | 5.0% |
| 5-Hydroxyisophthalic acid | 4.0% |
| Polyvinylpyrrolidone-co-acrylic acid | 2.0% |
| Isopropyl alcohol | 30% |
| Deionized water | 48% |

The dry membrane was imaged with an HP 2500 Series Printer to obtain a very high density, dry, and smudge-free image which was resistant to wet-rub and water migration immediately after printing.

The experiment was repeated, without migration inhibitor, using a different coating solution of

| | |
|---|---|
| Aluminum sulfate, tetradecahydrate | 5.75% |
| Dioctylsodiumsulfosuccinate | 9.0% |
| Silwet L 7607 | 0.75% |
| Surfynol 104PA | 2.25% |
| Isopropyl Alcohol | 25.0% |
| Deionized Water | 57.25% |

After coating and drying, the membrane was imaged with an Encad printer fitted with 3M inks. The image was overlaminated with a 3M product called #8519 from the Commercial Graphics Division, and partially submerged in water. The black and cyan pigments began to move in less than 20 minutes as the water traveled through the membrane.

The experiment was repeated with the same coating solution except that 2.0% polyvinylpyrrolidone-co-acrylic acid (75/25) was added to the receptor solution, reducing the water accordingly. After imaging and overlaminating with #8519, the image was partially submerged in water for 24 hours where it was observed that no ink had migrated from its original location.

It has been observed that not only does the migration inhibitor of the present invention minimize pigment migration as water enters into the imaged membrane, but also the pigment migration is minimized as water recedes. Thus, the image is preserved as much as possible regardless of the location of water about the membrane and which way the water is moving.

The invention is not limited to the above embodiments. The claims follow.

What is claimed is:

1. An inkjet receptor medium suitable for imaging with a pigmented ink, comprising:

a porous substrate;

a pigment management system comprising a multivalent metal salt coating or functionalized particulates in contact with surfaces of pores of the porous substrate; and a migration inhibitor within the porous substrate, wherein the migration inhibitor comprises a copolymer comprising at least two different copolymerized monomers whose homopolymers are hydrophilic, wherein the copolymer is capable of inhibiting migration of a pigmented ink when the receptor medium having a pigmented ink image thereon comes in contact with water, and further wherein the copolymer has a number average molecular weight of about 10,000 to about 300,000 and is sparingly soluble in water.

2. The inkjet receptor medium of claim 1, wherein the monomers are selected from the group consisting of methacrylic acid, ethacrylic acid, acrylic acid, N-vinylphthalimide, vinylimidazole, vinylpyridine, and N-vinyl-2-pyrrolidinone, and combinations thereof.

3. The inkjet receptor medium of claim 2, wherein the copolymer is N-vinyl-2-pyrrolidinone-co-acrylic acid.

4. The inkjet receptor medium of claim 3, wherein the weight ratio of N-vinyl-2-pyrrolidinone to acrylic acid is within a range of about 65:35 to about 90:10.

5. The inkjet receptor medium of claim 1, wherein the copolymer is selected from the group consisting of a copolymer of N-vinylpyrrolidone, acrylic acid, and trimethoxysilylethylmethacrylate (80/10/10); a copolymer of N-vinylpyrrolidone, acrylic acid, trimethoxysilylethylnethacrylate, and ethyleneoxide acrylate (75/10/5/10); a copolymer of N-vinylpyrrolidone, acrylic acid, and N, N, N-methyloctylheptadecafluorosulfonylethylacrylate (MeFOSEA) (80/10/10); a copolymer of N-vinylpyrrolidone, acrylic acid, trimethoxysilylethylmethacrylate and N, N, N-ethyloctylheptadecafluorosulfonylethylacrylate (MeFOSEA) (83/10/2/5); and a copolymer of N-vinylpyrrolidone, acrylic acid, and sulfonated styrene (60/10/30).

6. The inkjet receptor medium of claim 1, wherein the porous substrate comprises a microporous membrane with tortuous paths.

7. The inkjet receptor medium of claim 6, wherein the microporous membrane is a thermally induced phase separated microporous membrane.

8. The inkjet receptor medium of claim 1 further comprising a surfactant impregnated into pores of the porous substrate.

9. The inkjet receptor medium of claim 1, wherein the functionalized particulates comprise fluorinated silica agglomerates.

10. An inkjet receptor medium suitable for imaging with a pigmented ink, comprising:

a microporous substrate;

a pigment management system comprising a multivalent metal salt coating or functionalized particulates in contact with surfaces of pores of the microporous substrate;

a fluid management system comprising a surfactant in contact with surfaces of pores of the microporous substrate; and a migration inhibitor within the microporous substrate, wherein the migration inhibitor comprises a copolymer comprising at least two different copolymerized monomers whose homopolymers are hydrophilic, wherein the copolymer is sparingly soluble in water and has a number average molecular weight of about 10,000 to about 300,000.

11. The inkjet receptor medium of claim 1 further comprising an image formed from a pigmented ink.

12. A method of forming an image, the method comprising:

providing an inkjet receptor medium of claim 1; and delivering a pigmented ink to the inkjet receptor medium.

* * * * *

UNITED STATES PATENT AND TRADEMARK OFFICE

CERTIFICATE OF CORRECTION

PATENT NO. : 6,537,650 B1
DATED : March 25, 2003
INVENTOR(S) : Waller, Clinton P. Jr.

It is certified that error appears in the above-identified patent and that said Letters Patent is hereby corrected as shown below:

Title page,
Item [56], OTHER PUBLICATIONS, fifth entry, "Honby et al.," should read -- Hornby et al. --.

Column 6,
Line 61, delete the word "said".

Column 7,
Line 39, after "acrylic acid" please insert -- , --.
Line 49, after "2,000,000" insert -- , --.

Column 8,
Line 64, "Homby et al.," should read -- Hornby et al. --.

Column 9,
Lines 47 - 60, please delete the formula depicted and insert the following:

--

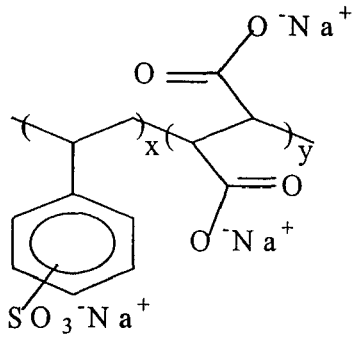

--

Column 10,
Line 13, after "pigment migration" insert -- . --.

UNITED STATES PATENT AND TRADEMARK OFFICE

CERTIFICATE OF CORRECTION

PATENT NO. : 6,537,650 B1
DATED : March 25, 2003
INVENTOR(S) : Waller, Clinton P. Jr.

It is certified that error appears in the above-identified patent and that said Letters Patent is hereby corrected as shown below:

Column 11,
Line 5, "Air products" should read -- Air Products --.
Line 8, "characetistics" should read -- characteristics --.
Line 33, "and );" should read -- and --.

Column 12,
Line 49, "coating solution 2" should read -- coating solution of 2 --.

Signed and Sealed this

Fourth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,537,650 B1
DATED : March 25, 2003
INVENTOR(S) : Waller, Clinton P. Jr.

It is certified that error appears in the above-identified patent and that said Letters Patent is hereby corrected as shown below:

Column 6,
Line 47, after "incorporated herein." please insert -- The pigment management system includes multivalent metal salt coating or functionalized particulates impregnated into pores of the porous membrane such that they are in contact with surfaces of pores of the porous membrane. --
Line 49, after "impregnated with" delete the phrase "an inorganic" and replace it with -- a --.

Signed and Sealed this

Twenty-third Day of March, 2004

JON W. DUDAS
*Acting Director of the United States Patent and Trademark Office*